US006316710B1

(12) United States Patent
Lindemann

(10) Patent No.: US 6,316,710 B1
(45) Date of Patent: Nov. 13, 2001

(54) MUSICAL SYNTHESIZER CAPABLE OF EXPRESSIVE PHRASING

(75) Inventor: Eric Lindemann, 2975 18th St., Boulder, CO (US) 80304

(73) Assignee: Eric Lindemann, Boulder, CO (US)

( * ) Notice: Subject to any disclaimer, the term of this patent is extended or adjusted under 35 U.S.C. 154(b) by 0 days.

(21) Appl. No.: 09/406,459

(22) Filed: Sep. 27, 1999

(51) Int. Cl.[7] ..... G10H 7/00

(52) U.S. Cl. ..... 84/609; 84/601; 84/602; 84/622; 84/649; 84/659

(58) Field of Search ..... 84/600–606, 609–612, 84/622–627, 634–636, 649–652, 659–660, 666–668

(56) References Cited

U.S. PATENT DOCUMENTS

| | | | | |
|---|---|---|---|---|
| 4,083,283 | | 4/1978 | Hiyoshi . | |
| 4,332,183 | | 6/1982 | Deutsch . | |
| 4,524,668 | | 6/1985 | Tomisawa . | |
| 4,726,276 | | 2/1988 | Katoh . | |
| 5,216,189 | | 6/1993 | Kato . | |
| 5,292,995 | | 3/1994 | Usa . | |
| 5,375,501 | * | 12/1994 | Okuda | 84/611 |
| 5,610,353 | | 3/1997 | Hagino . | |
| 6,066,794 | * | 5/2000 | Longo | 84/626 |
| 6,124,543 | * | 9/2000 | Aoki | 84/609 |

* cited by examiner

*Primary Examiner*—Marlon T. Fletcher

(57) ABSTRACT

The present invention describes a device and methods for synthesizing a musical audio signal. The invention includes a device for storing a collection of sound segments taken from idiomatic musical performances. Some of these sound segments include transitions between musical notes such as the slur from the end of one note to the beginning of the next. Much of the complexity and expressivity in musical phrasing is associated with the complex behavior of these transition segments. The invention further includes a device for generating a sequence of sound segments in response to an input control sequence—e.g. a MIDI sequence. The sound segments are associated with musical gesture types. The gesture types include attack, release, transition, and sustain. The sound segments are further associated with musical gesture subtypes. Large upward slur, small upward slur, large downward slur, and small downward slur are examples of subtypes of the transition gesture type. Event patterns in the input control sequence lead to the generation of a sequence of musical gesture types and subtypes, which in turn leads to the selection of a sequence of sound segments. The sound segments are combined to form an audio signal and played out by a sound segment player. The sound segment player pitch-shifts and intensity-shifts the sound segments in response to the input control sequence.

53 Claims, 9 Drawing Sheets

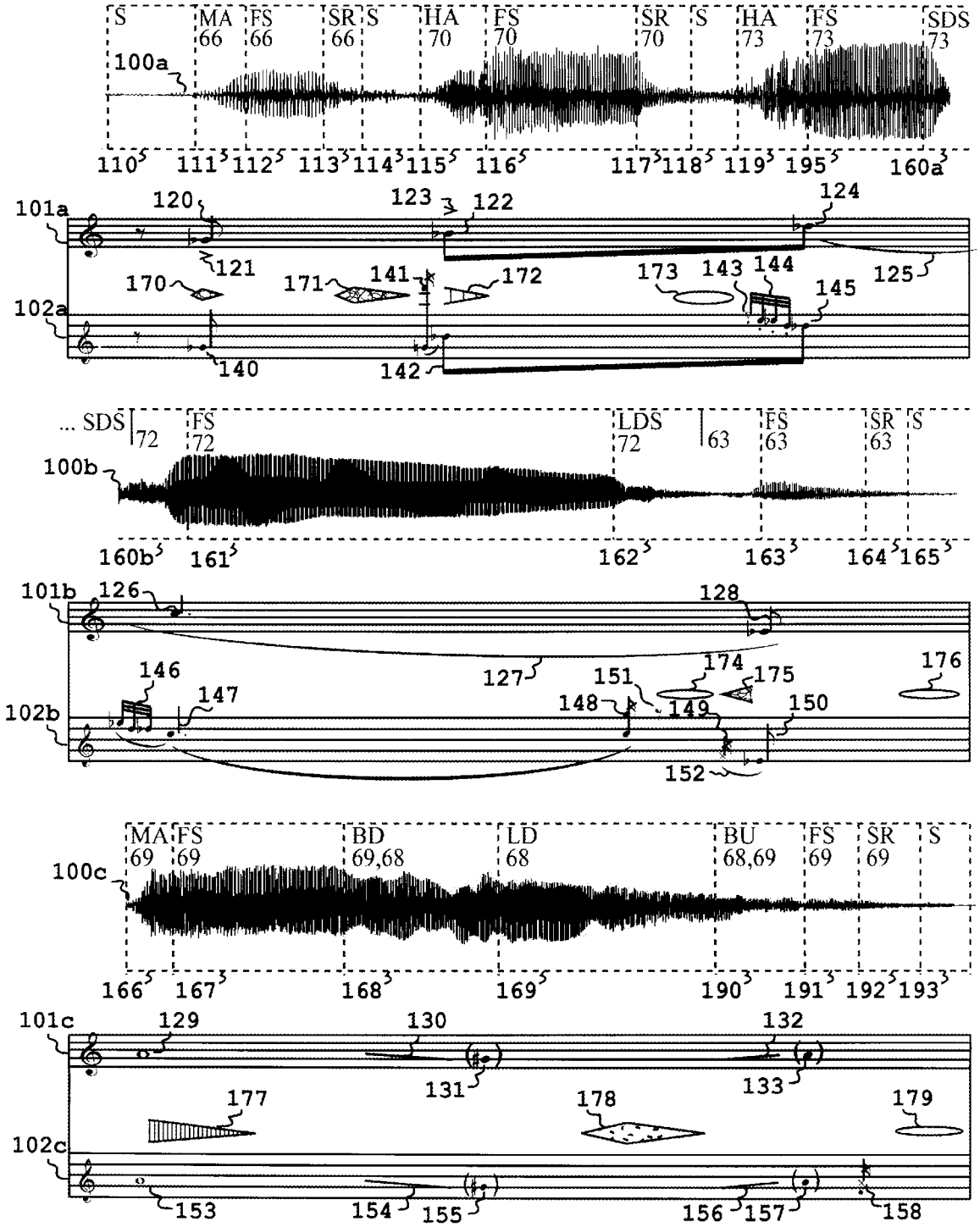
Figure 1 (INFORMATIVE)

| gesture type | gesture subtype | gesture symbol |
|---|---|---|
| attack | breathy_attack | BA |
| | soft_attack | SA |
| | medium_attack | MA |
| | hard_attack | HA |
| release | breathy_release | BR |
| | soft_release | SR |
| | medium_release | MR |
| | hard_release | HR |
| | falloff_release | FR |
| transition | small_downward_slur | SDS |
| | large_downward_slur | LDS |
| | small_upward_slur | SUS |
| | large_upward_slur | LUS |
| | run_up_slur | RUS |
| | run_down_slur | RDS |
| sustain | flat_sustain | FS |
| | vibrato_cycle | VP |
| | lip_down_sustain | LD |
| | bend_down | BD |
| | bend_up | BU |
| silence | silence | S |

Figure 2

| gesture type | gesture subtype | conditions |
|---|---|---|
| silence | idle | |
| attack | breathy_attack | for last note_on:<br>intensity <= BREATHY_INTENSITY<br>& pitch < BREATHY_PITCH |
| | soft_attack | for last note_on:<br>HARD_INTENSITY> intensity > BREATHY_INTENSITY<br>& HARD_PITCH > pitch > BREATHY_PITCH |
| | hard_attack | for last note_on:<br>intensity >= BREATHY_INTENSITY<br>& pitch >= BREATHY_PITCH |
| sustain | flat_sustain | (current mod_wheel) < VIBRATO_MIN |
| | vibrato_sustain | (current mod_wheel) >= VIBRATO_MIN |
| | upward_bend_sustain | (current pitch_bend_wheel) > 0 |
| | downward_bend_sustain | (current pitch_bend_wheel) < 0 |
| transition | run_up_slur | for 3 of 4 last notes_ons:<br>pitch_diff <= RUN_INTERVAL<br>& for last 4 notes_durations:<br>note_duration <= RUN_NOTE_LENGTH |
| | run_down_slur | for 3 of 4 last note_ons:<br>pitch_diff <= RUN_INTERVAL<br>& for last 4 note_durations:<br>note_length <= RUN_NOTE_LENGTH |
| | large_upward_slur | for last note_on:<br>pitch_diff>=LARGE_INTERVAL |
| | large_downward_slur | for last note_on:<br>pitch_diff<=-LARGE_INTERVAL |
| | small_upward_slur | for last note_on:<br>0<pitch_diff<LARGE_INTERVAL |
| | small_downward_slur | for last note_on: 0>pitch_diff>=-LARGE_INTERVAL |
| release | soft_release | for last note_off:<br>release_intensity < FAST_RELEASE |
| | hard_release | for last note_off:<br>release_intensity >= FAST_RELEASE |
| | falloff_release | determined by current state |

Figure 6

MUSICAL SYNTHESIZER CAPABLE OF EXPRESSIVE PHRASING

CROSS-REFERENCE TO RELATED APPLICATIONS

Title: System for Encoding and Synthesizing Tonal Audio Signals
Inventor: Eric Lindemann
Filing Date: May 6, 1999
U.S. PTO application Ser. No. 09/306256
Title: Audio Signal Synthesis System Based on Probabilistic Estimation of Time-Varying Spectra
Inventor: Eric Lindemann
Filing Date: Sep. 7, 1999
U.S. PTO application Ser. No. 09/390918

FIELD OF THE INVENTION

This invention relates to a system for modeling realistic musical instruments and phrasing in an electronic music synthesizer.

BACKGROUND OF THE INVENTION

Electronic music synthesizers have had difficulty capturing the sound and phrasing of expressive instruments such as violin, saxophone, and trumpet. Even traditional sampling synthesizers, which use actual recordings of real instruments, are unable to reassemble these recordings to form expressive phrases.

A traditional sampling synthesizer can be viewed as a system that stores in memory, a digitized recording of a highly constrained musical performance. The performance consists of a number of notes covering the pitch and intensity range of the instrument, separated by brief periods of silence. In response to a note_on command, with associated pitch and intensity values, the sampling synthesizer searches through the stored performance for the location of a note that most nearly matches the pitch and intensity associated with the note_on command. The recorded note is then read out of memory, further pitch-shifted, and amplitude scaled to achieve a more precise match with the desired pitch and intensity, and then output through a digital-to-analog converter.

Generally, three to four notes per octave with two to three intensity levels are stored in sampler memory. The amount of memory required is often quite large especially if a number of different instrumental sounds are desired. It is not practical to store very long note recordings-two to three seconds is typical. To synthesize long sustained notes, looping techniques are used. After playing the start of a recording, a segment of a note recording is played back repeatedly until the note is released. A relatively stable segment is chosen so that jumping from the end to the beginning of the segment does not introduce obvious discontinuities. Sometimes the discontinuity associated with the loop jump is smoothed over by cross-fading from the end to the beginning of the loop segment.

For expressive instruments, the traditional sampling synthesizer often sounds unnatural, like a succession of unrelated notes rather than a musical phrase. Sustained notes often have an undesirable periodic pulsation due to looping. When the loop segment is extremely short—e.g. one pitch period—the result sounds like an electronic oscillator rather than a natural instrument.

The reason for the failure to synthesize expressive phrases is that, for expressive instruments such as trumpet, violin and saxophone, real performances are not simply the concatenation of a number of isolated notes. Complex, idiosyncratic behavior occurs in the transition from one note to the next. This behavior during note transitions is often the most characteristic and identifiable aspect of instrumental sounds.

Various attempts have been made to enrich the kinds of note transitions generated by traditional synthesizers. U.S. Pat. No. 4,083,283, to Hiyoshi et al., teaches a system where, for a smooth slurred transition between notes, the amplitude envelope is held constant during the transition, whereas the envelope will begin with an attack segment for non-slurred transitions. U.S. Pat. No. 5,216,189, to Kato, teaches a system where amplitude and pitch envelopes are determined by certain note transition values, for example, pitch difference between successive notes. U.S. Pat. No. 4,332,183, to Deutch, teaches a system where the Attack-Decay-Sustain-Release (ADSR) amplitude envelope of a tone is determined by the time delay between the end of the preceding tone and the start of the tone to which the ADSR envelope is to be applied. U.S. Pat. No. 4,524,668, to Tomisawa et al., teaches a system where a slurred transition between notes can be simulated by generating a smooth transition from the pitch and amplitude of a preceding tone to the pitch and amplitude of a following tone. U.S. Pat. No. 4,726,276, to Katoh et al., teaches a system where, for a slurred transition between notes, pitch is smoothly changed between notes, and a stable tone color is produced during the attack of the second tone, whereas a rapidly changing tone color is produced during the attack of the second tone of a non-slurred transition. Katoh et al. also teaches the detection of slurred tones from an electronic keyboard by detecting the depression of a new key before the release of a preceding key. U.S. Pat. No. 5,292,995, to Usa, teaches a system, where a fuzzy operation is used to generate a control signal for a musical tone based on the time lapse between one note_on command and the next. U.S. Pat. No. 5,610,353, to Hagino, teaches a system where a slurred keyboard performance is detected based on a second key depression before a preceding key has been released, and where sampled tones stored in memory have two start addresses: a normal start address and a slur start address. The slur start address is presumably offset into the sustained part of the tone. On detection of legato, a new tone is started at the slur start address.

All of these inventions attempt to provide smooth transitions for slurs by artificially manipulating the data associated with isolated note recordings: starting a note after its recorded attack, reducing the importance of an attack by superimposing a smooth amplitude envelope, etc. None of these techniques captures the dynamics of the natural instrument in slurred phrasing, let alone the wide variety of non-slurred note transition types present in an expressive instrumental performance.

In addition, none of these inventions addresses the problem of generating natural sustains without the periodic pulsing or electronic oscillator sound found with traditional looping techniques.

SUMMARY OF THE INVENTION

The deficiencies of the traditional sampling synthesizer, especially the inadequate modeling of note transitions and note sustains, lead to a number of objects and advantages of the present invention.

One object of the present invention is to generate a rich variety of realistic note transitions in response to electronic music controller commands.

Another object of the present invention is to support instrumental effects, such as lip glissandi, in a natural way, so that they sound well integrated with surrounding notes in a musical phrase.

Another object of the present invention is the modeling of natural sounding note sustains without introducing undesirable low frequency periodicity or static single period electronic oscillator artifacts.

Still further objects and advantages of the present invention will become apparent from a consideration of the ensuing description and drawings.

The present invention stores recordings of expressive phrases from real instrumental performances. These recordings are divided into sound segments corresponding to various musical gestures such as attacks, releases, note transitions, and note sustains. On receipt of commands from an electronic music controller, the synthesizer jumps to desired sound segments. The sound segments include slurred note transitions that comprise the end of one note, where the slur begins, and the beginning of the next note. Sound segments also include idiosyncratic note attacks and releases, and various sustained parts of notes, including individual vibrato cycles.

The sound segments are often pitch-shifted and intensity-shifted before begin played out. The sound segments may be encoded as time-domain waveforms or, preferably, as a sequence of spectral coding vectors. The special properties of the spectral coding format are exploited to allow pitch-shifting without altering the time-varying characteristics of the sound segments, and realistic modification of the intensity of the sound segments.

DESCRIPTION OF DRAWINGS

FIG. 1—An annotated sound waveform correspond to a musical phrase. The waveform is segmented into musical gestures. A standard musical notation transcription of provided, in addition to supplemental musical notations showing detailed micro-sequence musical events. (INFORMATIVE)

FIG. 2—Musical gesture table showing musical gesture types, musical gesture subtypes, and symbols representing musical gesture subtypes.

FIG. 6—Gesture subtype selection table.

DESCRIPTION OF PREFERRED EMBODIMENTS

Figure 3:
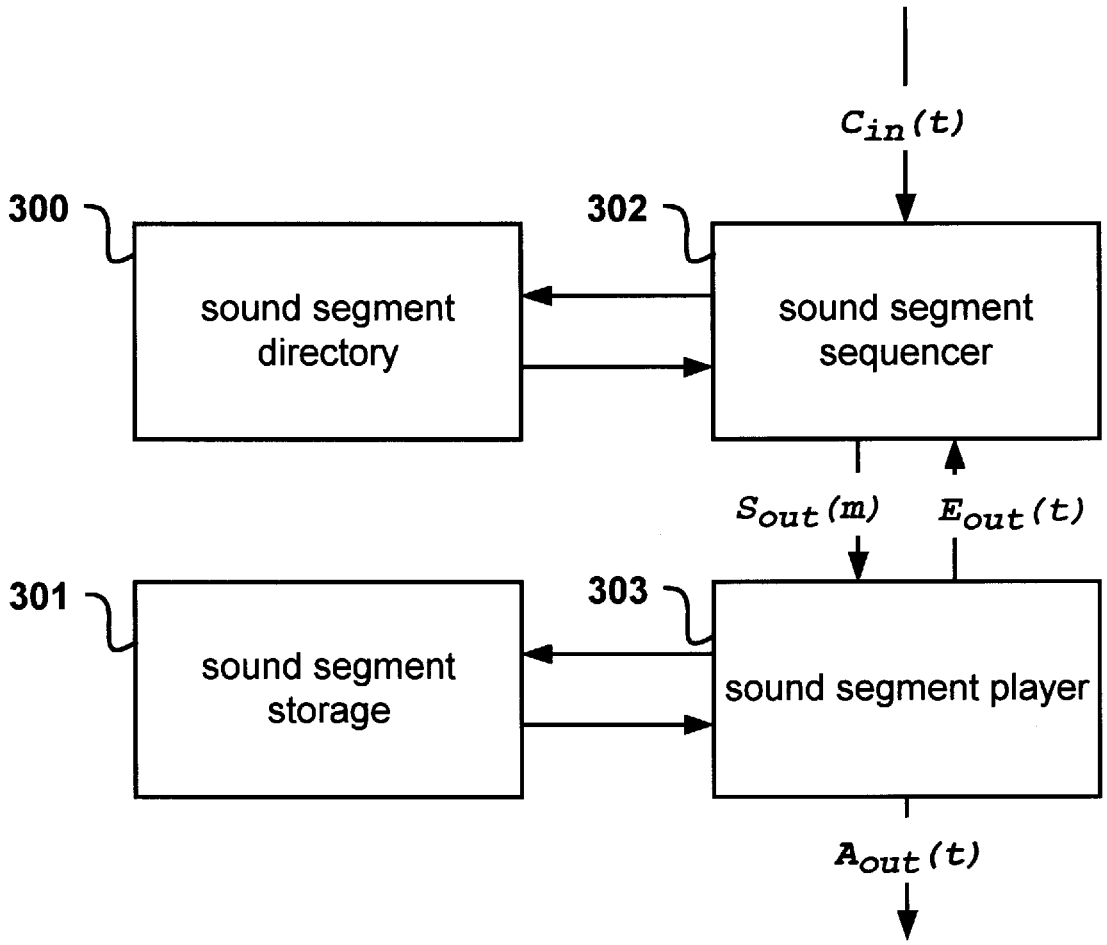
FIG. 3—Block diagram overview of the musical synthesizer of the present invention.

Expressive musical instrument performances include a wide variety of attacks, releases, transitions between notes, and note sustains. These musical "gestures" determine the character of the musical instrument as well as the personal style of the performer. The present invention is a musical synthesizer that captures much of the richness and complexity of these musical gestures.

To better understand the character of these gestures, FIG. 1 shows a representation of a musical phrase from a jazz trumpet performance. 100*a*,100*b*,100*c* are plots of the time domain waveform of the recorded phrase. There are also two musical transcriptions of the recorded phrase. The first is shown on musical staves 101*a*,101*b*,101*c*. The second transcription is shown on staves 102*a*,102*b*,102*c*.

The time domain waveform 100*a*,100*b*,100*c* is divided into sound segments shown by boxes made from dotted lines. 110, 111, 112 are examples of these sound segment boxes. Each sound segment corresponds to a musical gesture. The letters in the upper left hand corner of each segment box form a symbol that represents the subtype of the gesture. FIG. 2 shows the "gesture table" for the jazz trumpet instrument. The gesture table lists the different gesture types, the gesture symbols, and the corresponding gesture subtypes for the jazz trumpet. Each instrument-trumpet, violin, saxophone, etc.—has a characteristic set of gestures represented by a gesture table.

As can be seen in FIG. 2, the musical gesture types for the jazz trumpet include:

1. attack—corresponding to the beginning section of a note after a period of silence.
2. release—corresponding to the ending section of a note before a period of silence.
3. transition—corresponding to the ending section of one note and the beginning section of the next note, in the case where there is little or no silence—e.g. less than 250 milliseconds of silence-between the two notes. A slur is a typical example of a transition, although articulated transitions are also possible.
4. sustain—corresponding to all or part of the sustained section of a tone. A tone may have zero, one, or several sustain sections. The sustain sections occur after the attack and before the release.
5. silence—a period of silence between tones.

Each gesture can have a number of subtypes represented by a symbol.

Sound segment 160 of FIG. 1 is labeled "SDS". This corresponds to a small downward slur that, as seen in FIG. 2, is a subtype of the transition gesture type. The phrase "small downward" refers to a small downward interval for the slur—in this case a descending half-step spanning the end of note 124 and the beginning of note 126. Sound segment 162 is labeled "LDS" for large downward slur—in this a descending major sixth spanning the end of note 126 to the beginning of 128. Sound segment 161 is labeled "FS" for flat sustain and spans the entire sustain section of note 126.

The number below each gesture symbol—e.g. the value 72 below "FS" in sound segment 161—indicates the pitch associated with the segment. The pitch value is given as a MIDI pitch number. MIDI pitch 69 is A440. For MIDI, every integer step in pitch corresponds to a musical half-step, so MIDI pitch 66 is G flat below A440 as indicated in the musical transcriptions by note 121.

Notes 126 and 128 on musical staff 101*b* are connected by slur 127. What is notated on staff 101*b*, and what the listener perceives when listening to the recorded phrase, is a simple slur gesture. When the trumpet player performs this slur over the large descending interval C to E flat, the lower note takes time to speak. In fact, there are a number of short intervening tones and noises that occur in between the two notes. These intervening tones are notated in detail in the second musical transcription on staff 102*b*. As can be seen, what actually occurs in the recorded phrase is a soft, short multi-tone 148 at the end of the first note 147, followed by a brief silence, then a soft short tone with ill-defined pitch 149 followed immediately by the E flat tone 150. The X-shaped note-head on 149 indicates that the pitch is ill-defined.

Above musical staff 102*b* are a number of special notations. The oval 174 indicates silence. The crescendo mark 175 filled with swirling lines indicates noise of increasing volume. The noise in this case is due to air passing through the trumpet before oscillation of the E flat tone 150 sets in.

The trumpet player is not deliberately trying to execute this complicated sequence, with its short intervening tones and noises. He is simply trying to execute a slur. The complicated sequence occurs because of the interaction of his lips, breath, and tongue with the instrument. This is precisely the kind of complex behavior the present invention attempts to recreate.

Transition gestures, such as those corresponding to sound segments 160 and 162, involve two principal pitches: the beginning pitch, and the ending pitch. A region of the transition is defined in which the pitch changes continuously between notes. This is called the split region of the transition. This region may have zero length in the case where the pitch changes abruptly, or where there is a brief silence separating the beginning and ending pitch. In transition segments 160 and 162, the split region is zero length and its position in the segment is illustrated by a small solid vertical line. The vertical line is followed by a number representing the ending pitch of the transition. The beginning pitch is shown underneath the gesture subtype symbol. As we shall see below, release segments also have split points (split regions of zero length), although no pitch change occurs at these points and they are not marked on FIG. 1.

The present invention synthesizes an output audio signal by playing sequences of sound segments. The sound segments correspond to musical gestures including attacks, releases, transitions, and sustains as described above. FIG. 3 shows a block diagram of key elements of the present invention. Sound segment storage 301 is a collection of sound segments taken from one or more idiomatic instrumental performances. The sound segments are digitally encoded and stored in a storage means such as computer memory or computer disk.

Sound segment directory 300 is stores offset pointers into the sound segment storage 301 to define the beginning and ending of the sound segments as well as the beginning of the split regions for transition and release segments. In addition to pointers, each entry in the sound segment directory includes a sound segment descriptor. The sound segment descriptor tells the gesture type, gesture subtype, pitch, intensity and other information relating to the sound segment. The term "intensity" is associated with a note_on message and a sound segment. In case of the intensity of a sound segment we mean a value related to the average amplitude, power, or loudness of the sound segment.

In one embodiment of sound segment storage 301, encoded recordings of entire musical phrases, such as the phrase in FIG. 1, are stored contiguously in the storage means. In another embodiment of block 301, the sound segments are stored separately in the storage means, with no particular relationship between adjacent segments. The details of organization of 301 are unimportant as long as the sound segment directory 300 contains the relevant pointer and sound segment descriptor information.

In FIG. 3, $C_{in}(t)$ represents the input musical control sequence. In one embodiment, this control sequence corresponds to a discrete sequence of note on and note_off messages together with continuous control messages. The note_on and note_off messages have pitch and intensity values associated with them. This corresponds to the case of a control sequence conforming to the well-known MIDI standard. In the case of MIDI, the intensity value is referred to as "velocity", since it often corresponds to the strike velocity of a MIDI keyboard controller. We will continue to refer to intensity in this specification, since it is a more general description of the meaning of this value.

In a MIDI sequence, a note_on message with pitch value P initiates a note, and a note_off message with pitch value P ends that note. There is ambiguity in this specification since, in a polyphonic context, there may be several note_on messages with pitch P before a note_off message with pitch P is received. The particular note_on to which the note_off refers is ambiguous. Often the most recent note_on is selected by default. In a variant on the MIDI standard, a unique identifier is associated with each note_on message, and the note_off message, rather than including a pitch value, include this unique identifier. This removes the ambiguity.

In another embodiment of the present invention, the input control sequence $C_{in}(t)$ in FIG. 3 represents, more directly, movements associated with physical performance. For example, messages in the $C_{in}(t)$ control sequence may correspond to key closures, tonguing events, and changes in breath pressure for an electronic wind controller. The general form of $C_{in}(t)$ does not affect the essential character of the present invention.

The sound segment sequencer 302 in FIG. 3 makes decisions about the sequencing of sound segments over time. These decisions are based on two event sequences: $C_{in}(t)$ and $E_{out}(t)$. $C_{in}(t)$ was discussed above. $E_{out}(t)$ is generated by the sound segment player 303 and will be discussed below. Sound segments may be played out in their entirety or interrupted to switch to a new sound segment. Sound segments may be modified during play—e.g. pitch-shifted and/or intensity-shifted.

The sound segment player 303 plays out sound segments, converting them to an output audio signal. The sound segment player 303 applies modifications to the sound segments and performs operations relating to splicing and cross-fading consecutive sound segments. Often the amplitude of a sound segment will be smoothly ramped down towards the end of the playing out of that sound segment, while the amplitude of the following sound segment is smoothly ramped up at the beginning of playing out of the following sound segment. In this way, a smooth cross-fade between successive sound segments is implemented. This helps to provide the perception of a continuous tone rather than a series of independent segments.

The sound segment player 303 also generates segment events $E_{out}(t)$ used by the sound segment sequencer 302. There are three types of events generated by the sound segment player 303:

1. end_segment—this event signals that the sound segment player has reached the end of a segment.
2. transition_split—this event signals that the sound segment player has reached the beginning of the split region of a transition segment where pitch begins to change.
3. release_split—this event signals that the sound segment player has reached the split point of a release segment. The purpose of this event will be discussed below.

Figure 4:
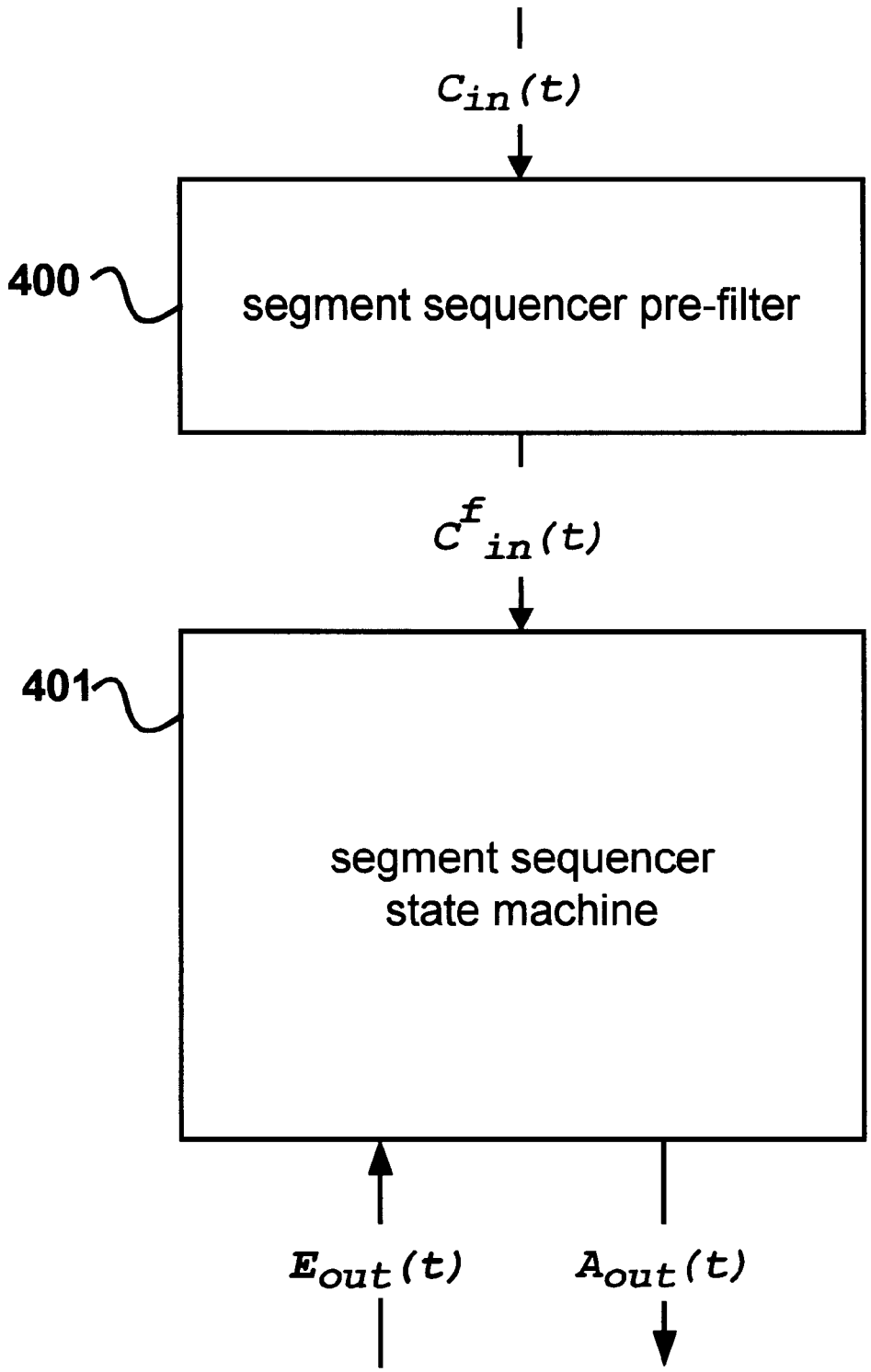
FIG. 4—Block diagram of the sound segment sequencer.

FIG. 4 shows a block diagram of one embodiment of the sound segment sequencer. The input control sequence $C_{in}(t)$ in FIG. 4 is a MIDI sequence consisting of note_on, note_off, and continuous controller messages. The segment sequencer of FIG. 4 is geared toward expressive monophonic voices—e.g. woodwind and brass. The segment sequencer detects different kinds of musical phrasing based on analysis of the input control sequence $C_{in}(t)$. In particular, a slurred phrasing is detected if a new note_on message is received before the note_off message corresponding to the previous note_on. For example, the sequence note_on, note_on, note_off, note_off corresponds to two slurred notes, whereas the sequence note_on, note_off, note_on, note_off corresponds to two detached notes. A longer slurred sequence may appear as note_on, note_on, note_off, note_on, note_off, note_on, note_off, note_on, note_off, note_off. For these longer slurred sequences, only the final note_off of the sequence has meaning. The segment sequencer pre-filter 400 detects slurred phrasing and removes the unnecessary note_offs from the input control sequence $C_{in}(t)$ to generate the filtered input control sequence $C^f_{in}(t)$.

Figure 5:
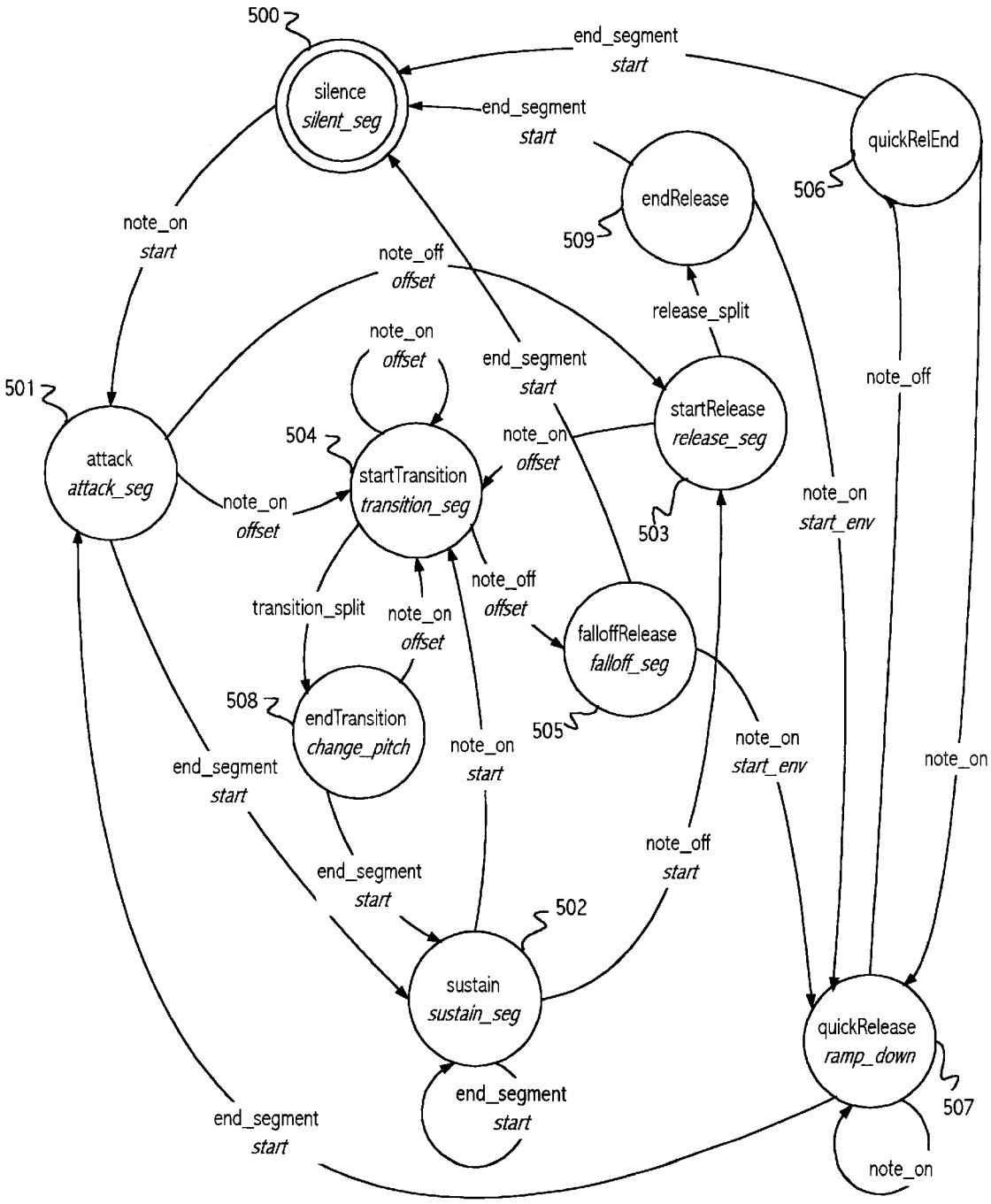
FIG. 5—State transition diagram of the segment sequencer state machine.

The main work of the sound segment sequencer of FIG. 4 is performed by the segment sequencer state machine 401. FIG. 5 shows a state transition diagram of the segment sequencer state machine 401. A state transition diagram shows a number of states represented by circles. The state machine receives event inputs, which in this case consist of note_on and note_off events (also called messages) from $C^f_{in}(t)$, and end_segment, transition_split, and release_split events from $E_{in}(t)$. At any time, the state machine is in one state. When an input event is received, a transition may be made to a new state. The new state is a function of the current state and the received input. The input dependent state transitions are represented in FIG. 5 by arcs with arrows showing the direction of the state transition. The arcs are labeled with the input event that triggers the state transition. For example, if the current state is "silence" 500, and a note_on event is received, then a transition is made to the "attack" state 501. The non-italic arc label identifies the input event that triggers the state transition. Beneath the input event label, in italics, is the "splice_type" associated with the state transition. The splice_type will be discussed later. The double circle of state 500 indicates that it is the starting state for the state machine.

An action may be associated with entry into a state. This action is performed every time the state is entered. Actions appear in italics in FIG. 5 underneath the state name. For example, on entry into the attack state, the action attack_seg is performed. A state is not required to have an entry action associated with it.

When the synthesizer of the present invention is first turned on the segment sequencer state machine enters the silence state 500 and the action silent_seg is performed. This action tells the sound segment player 303 of FIG. 3 to begin outputting silence, and to continue doing so until further notice. On receipt of a note_on event from the filtered input control sequence $C^f_{in}(t)$ the segment sequencer state machine advances to the attack state 501, and the attack_seg action is performed.

In general, the current state in the state transition diagram will determine the gesture type but not the gesture subtype. This is true of state 501. To find an appropriate sound segment corresponding to the attack, the attack_seg action first invokes the find gesture_subtype( ) routine, to determine the gesture subtype. The action find_gesture_subtype( ) evaluates additional conditions to determine the gesture subtype. These conditions are described in a gesture subtype selection table, such as shown in FIG. 6. The gesture subtype selection table shows the already selected gesture type determined by the current state, the gesture subtypes corresponding to that gesture type, and the logical conditions which, if true, lead to the selection of that gesture subtype.

For example, if a transition has been made to the "attack" state 501, then the attack gesture type is already selected. If, in addition, the condition (for last note_on: intensity<←BREATHY_INTENSITY & pitch<BREATHY_PITCH) is true then the gesture subtype "breathy attack" is selected. The term last note_on refers to the very last note_on event received, which in this case is the note_on that triggered the transition to the attack state 501. BREATHY_INTENSITY and BREATHY_PITCH are constant a-priori defined threshold values.

Figure 7:
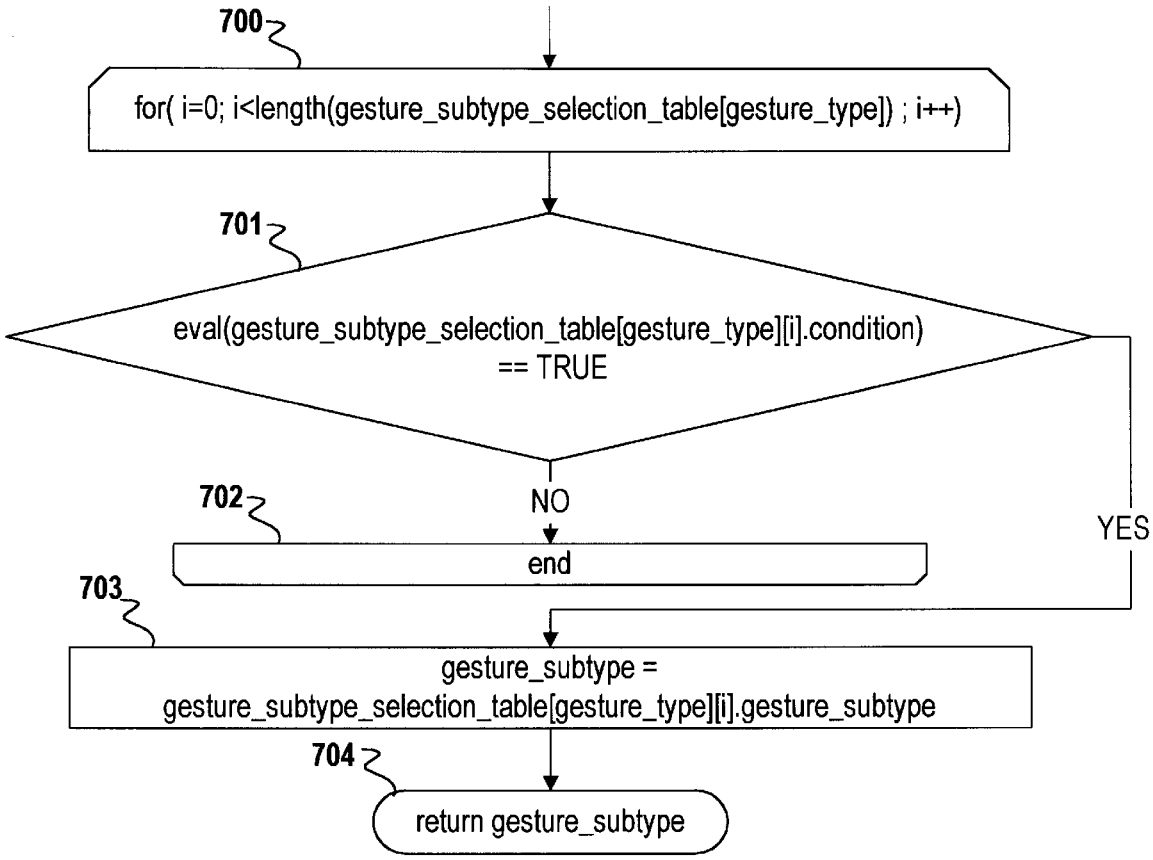
FIG. 7—Flow diagram of the find_gesture_subtype ( ) action.

FIG. 7 shows a flow diagram of the find_gesture_subtype( ) action. Block 700 represents the start of a loop. The gesture type—e.g. attack—is known on entry to the routine. The loop steps through each gesture subtype of the given gesture type selecting the condition associated with the gesture subtype as determined in the gesture subtype selection table. In 701, condition number "i" associated with the gesture subtype is evaluated. If the condition is true, then the correct gesture subtype has been found and the loop is broken and execution continues with block 703 where gesture subtype "i" is selected. Note that breaking out of the loop whenever a condition evaluates to true implies that earlier conditions in the gesture subtype selection table take precedence over later conditions. This feature is exploited in constructing gesture subtype selection tables. In 704, the selected gesture subtype is returned.

Each segment specified in the sound segment directory 300 of FIG. 3 is associated with a gesture subtype. There may be many sound segments associated with the same gesture subtype. For example, there may be many sound segments corresponding to gesture subtype "breathy attack". After find_gesture_subtype ( ) is executed, the action find_segment ( ) selects from among the many possible sound segments associated with the gesture subtype. The find_segment( ) action examines all segments associated with the selected gesture subtype to select the segment that best satisfies a number of matching criteria. These criteria are based on input control values and various current conditions—e.g. the current segment being played.

Figure 8:
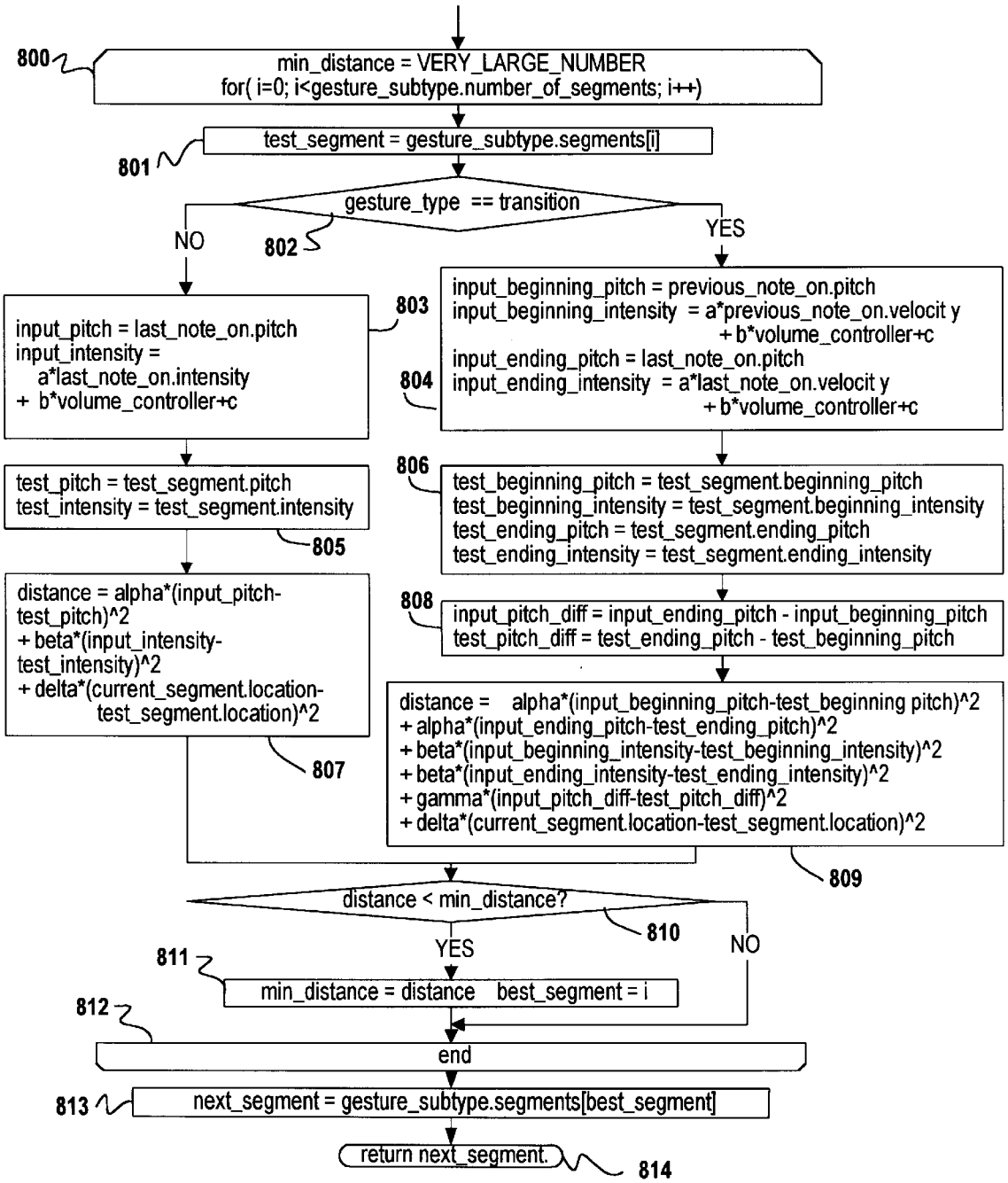
FIG. 8—Flow diagram of the find_segment ( ) action.

FIG. 8 shows a flow diagram of one embodiment of the find_segment( ) action. Block 800 is the beginning of a loop that examines each segment in the sound segment directory belonging to the selected gesture subtype. The variable min_distance is set to a large value before the loop beings so that the first distance value calculated in the loop will always be smaller than this initial value. In 801, the test segment is selected.

The calculation of distance is different for the transition gesture type than for the non-transition gesture type. In 802, the selected gesture type is tested to determine if it is a transition. If it is not a transition, as would be the case for finding an attack segment, then in 803 the input pitch and input intensity are determined.

Input pitch is simply the pitch value of the last (most recent) note_on event. Input intensity is a linear combination of the intensity value associated with the last note_on event and the current value of the volume controller—eg. MIDI volume pedal. The coefficients a, b, and c in this linear combination are arbitrary values that are set to select a weighting between note_on intensity and volume pedal values, and to offset and scale the linear combination so that the resulting value covers a range similar to the intensity range of the sound segments described in the sound segment directory. In 805, the test pitch and test intensity are set to the values associated with the test segment.

The non-transition distance is calculated in 807. The non-transition distance is a linear combination of squared differences between the input pitch and the test pitch, the input intensity and the test intensity, and current segment location and the test segment location. Here the term "location" means the location in an analysis input phrase from which the segment was originally taken. The difference between locations of segments taken from different phrases is ignored. The squared difference of pitch and intensity measure how closely the test segment pitch and intensity match the input pitch and intensity. Including the squared difference of current segment location and test segment location in the distance measure means that segments that are taken from nearby locations in a phrase will have a smaller distance than those further away. This encourages temporal continuity in segment selection.

If the synthesizer is in the sustain state 502 of FIG. 5, and a new note_on event occurs, then a transition will be made to the startTransition state 504, and the action transition_seg ( ) is performed. This actions initiates a search for an appropriate transition sound segment.

Transition gesture types have a beginning and ending pitch, and a beginning and ending intensity. Likewise, the input control criteria that result in selecting the transition gesture type involve a beginning and ending pitch and beginning and ending intensity. In 804 of the embodiment of the find_segment ( ) action of FIG. 8, the input beginning and ending pitch and intensity are calculated. The approach is similar to the non-transition case. Note that the beginning pitch and intensity use the "previous note_on" values. These correspond to the note_on event prior to the last (most recent) note_on event. The last note_on is used to calculate the input ending pitch and intensity. In 806, the test segment beginning and ending pitch and intensity are retrieved from the sound segment directory.

The transition distance calculation makes use of the difference between the beginning and ending pitch. These differences are calculated in 808. The pitch difference is particularly important because a large interval transition such as a large interval slur has a very different behavior than a small interval slur. This difference is largely accounted for by the different gesture subtypes corresponding to small and large upward and downward slurs. The transition distance measure further refines this selection.

In 809 the transition distance is calculated as a linear combination of squared differences between input and test beginning pitches, input and test ending pitches, input and test beginning intensities, input and test ending intensities, input and test pitch differences, and current segment location and test segment location. It is also possible to include the difference between beginning and ending intensities but this is not done in the embodiment of FIG. 8. The coefficients for the linear combination in 809 are set empirically to weight the different components.

In 810 the computed distance, whether for a transition or non-transition gesture type, is compared with the minimum distance found so far. If it is smaller, then in 811 the newly computed distance replaces the minimum distance and the current loop index "i" is saved to identify that "i" is the best segment so far, and 812 closes the loop. In 813 next segment is set equal to the best segment found and in 814 the find_segment( ) action returns next segment.

Figure 9:
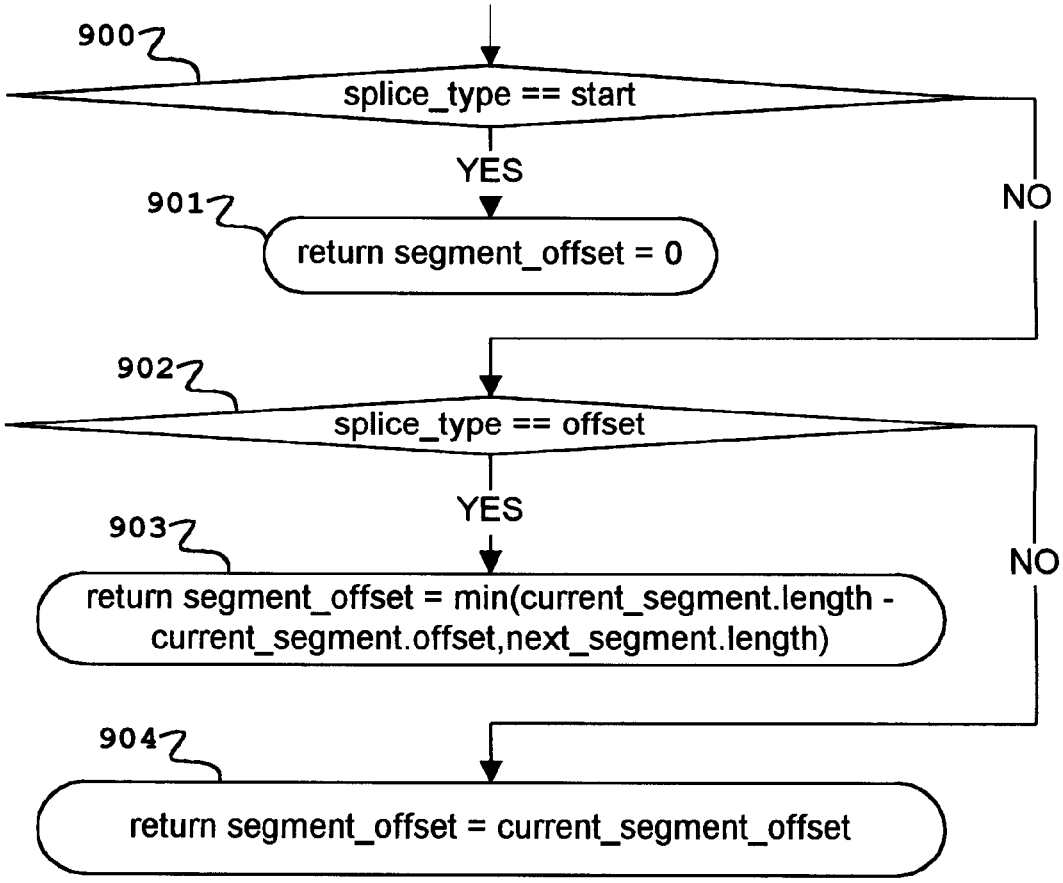
FIG. 9—Flow diagram of the find_segment_offset ( ) action.

Most of the state transitions in the state transition diagram of FIG. 5 involve a change to a new sound segment. Associated with any change from one sound segment to the next is a segment splice type. The splice_type is identified in FIG. 5 by the label in italics associated with the arc between two states. In addition to determining the segment splice_type, the starting offset in the new segment must be determined. This offset defines the point at which playback will begin for the new segment. FIG. 9 shows a flow diagram of the find_segment_offset ( ) action that calculates the starting offset for the new segment. The splice_type is tested in 900. If it is start then in 901 the starting playback point for the next segment is set to 0, which is the very beginning of the segment.

In some cases, it is desirable to start playing the next segment at some non-zero offset. This is the case, for example, when a release segment is started after only part of an attack segment has been played. By offseting into the release segment, a better match in levels is made with the current offset in the attack segment. This is the meaning of the splice_type offset. In 902, the splice_type is again tested. If it is offset, then in 903, the next segment offset is set equal to the distance between the current segment offset and the end of the current segment. As a safety measure, this offset is never allowed to be greater than the length of the next segment. This is a simple matching heuristic. In another embodiment, a more complex heuristic is used in which the amplitude envelopes of the segments are computed and the envelopes are cross-correlated to find a suitable matching point. The correlation takes into consideration not only matching of instantaneous level, but also slope and higher derivatives of the amplitude envelope. The amplitude envelopes may be highly decimated relative to the original signal and stored in the sound segment directory or sound segment storage. This, more complex, offset matching heuristic is not shown in the figures. As can be seen in FIG. 5, the offset splice_type is also used when changing from an attack segment to a transition segment, from one transition segment to another transition segment, and from a release segment to a transition segment.

If the splice_type is neither start nor offset, then in 904 the segment offset is set equal to the current segment offset. That is, the current segment continues playing from the current location. This is the case for state transitions where there is no change of sound segment and no splice_type given, such as in the transition from the startTransition state 504 of FIG. 5 to the endTranstion state 508, or from the startRelease state 503 to the endrelease state 509.

Sometimes it is necessary to terminate a note as quickly as possible in order to begin a new note. This is what occurs during the quickRelease state 507. Most transitions into the quickRelease state 507 are labeled with a start_env. When a transition is labeled with the start_env splice_type, then a downward ramping amplitude envelope is triggered. While in the quickRelease state 507, the downward ramping envelope continues until it reaches near zero amplitude, at which point an end_segment event is triggered and the state transition to the attack state 501 occurs.

A typical path through the state transition diagram of FIG. 5 starts in the initial silence state 500. On receipt of a note_on event a transition is made to the attack state 501 where the action attack_seg is performed. The action attack_seg finds an appropriate attack sound segment by invoking the series of actions find_gesture_subtype( ), find_segment ( ), and find_segment_offset( ). The action attack_seg ( ) then sends commands to the sound segment player 303 of FIG. 3 to beginning playing the attack sound segment at the prescribed offset.

At the end of the attack sound segment the sound segment player signals an end_segment event to the sound segment sequencer 302 of FIG. 3, and a transition is made to the sustain state 502 of FIG. 5, where the sustain_seg action is performed. The action sustain_seg finds an appropriate sustain sound segment by invoking the series of actions find_gesture_subtype( ), find_segment ( ), and find_segment_offset( ). The action sustain_seg( ) then sends commands to the sound segment player 303 to begin playing the sustain segment at the prescribed offset. At the end of the sustain sound segment, the sound segment player signals an end_segment event to the sound segment sequencer. If no note_off event has occurred, then the segment sequencer searches for another sustain sound segment and commands the sound segment player to play it. Many consecutive sustain sound segments may be played out in this manner. In one embodiment of the present invention, each cycle of a vibrato is modeled as a separate sound segment. Vibrato cycles correspond to the quasi-periodic pulsation of breath pressure by a wind player, or the quasi-periodic rotation of finger position for a string player. There are typically five to six vibrato cycles per second in a natural sounding vibrato.

When a note_off event is received by the sound segment sequencer, a transition is made to the startRelease state 503, where the action release_seg ( ) is performed. The action release_seg ( ) finds an appropriate release sound segment by again invoking the series of actions find gesture subtype ( ), find_segment ( ), and find_segment_offset ( ). The action release_seg ( ) then sends commands to the sound segment player to begin playing the release sound segment at the prescribed offset. Part way through the release sound segment a transition is made to the endRelease state 509. The release sound segment continues to play normally despite this state transition. The reason for the endRelease state will be described below. When the release sound segment has finished playing, the sound segment player again triggers an end_segment event that causes a state transition back to the original silence state 500.

There are many possible paths through the state transition diagram of FIG. 5. Each path through the state transition diagram can be seen to generate a sequence of musical gesture types in response to the input control sequence. In the example above, the sequence of musical gesture types is: silence, attack, sustain, release, silence. Since each sound segment in the sound segment storage is associated with a musical gesture type, it is possible for the sound segment sequencer to select a sequence of sound segments that matches the sequence of musical gesture types generated in response to the input control sequence.

By using the conditions in the gesture subtype selection table of FIG. 6, the sequence of musical gesture types is further refined to become a sequence of musical gesture subtypes. The sound segment sequencer selects a sequence of sound segments corresponding to this sequence of musical gesture subtypes.

As an example of another path through the state transition diagram, while in the sustain state 502 a new note_on event may be received because of an overlapped slurred phrasing from the performer. This triggers a transition to the start-Transition state 504, where the transition_seg( ) action is performed. In a manner similar to the sustain_seg ( ) action, the transition_seg ( ) action causes a transition segment to be found and played. When the split point is reached in the transition segment, the sound segment player generates a transition split event that triggers a transition to the endTransition state 508. On entry to the endTransition state the transition segment continues to play but the action change_pitch ( ) causes the pitch-shift applied to the transition sound segment to be modified. Pitch-shifting will be discussed in detail below. At the end of the transition segment an end_segment event triggers a transition to the sustain state 502.

It may happen, however, that a note_off event is received just after arriving in the startTransition state 504. This note_off event signals a particular performance idiom: rather than a simple slur, a falloff release is indicated. This triggers a transition to the falloffRelease state 505, where the action falloff_seg ( ) causes a falloff release sound segment to be found and played. At the end of the falloff release segment a transition is made back to the silence state 500. However, if during the falloffRelease state, a new note_on event is received, this signals that the falloff release sound segment should be immediately terminated so that a new note can begin. In order to avoid a click in the output audio the falloff release segment must be smoothly ramped down with an amplitude envelope. For this reason, the note_on event triggers a transition to the quickRelease state 507, where a ramp_down ( ) action is executed. The ramp_down ( ) action starts a quick decreasing amplitude envelope. When the envelope finishes, an end_segment event triggers a transition to the attack state 501 to start the new note. If, while in the quickRelease state a note_off event is received, this indicates that no new note is to be played after all, and a transition is made to the endQuickRelease state 506. While in this state, the decreasing amplitude envelope continues. When it ends, a transition is made to the silence state 500 unless another new note_on is received, in which a transition is made back to the quickRelease state. The decreasing amplitude envelope continues, followed by a transition back to attack state 501 for the new note.

Other paths through the state diagram may occur. For example, in the endrelease state 509 a new note_on event may occur. This causes a transition to the quickRelease state 507. This is the reason for the endrelease state 509. If, during the first part of a release segment, a note_on occurs then this triggers a transition to the startTransition state 504. Whereas, if the release is near the end, so that that a transition has been made to the endrelease state 509, then it is more appropriate to terminate the current note and start a new note from the attack state.

In another path, when a note_on event is received while in the transition state 504, then this triggers a new transition. This allows a fast series of transition segments.

We see then that, in response to input control events and sound segment play events, the sound segment sequencer 302 of FIG. 3 searches for appropriate sound segments in the sound segment directory 300, and sends commands to the sound segment player 303 to play out these sound segments. The sound segment player accesses these segments in the sound segment storage 301 at locations specified in the sound segment directory 300.

The gesture table of FIG. 2 shows run_up_slur and run_down_slur subtypes of the transition gesture type. When an instrumentalist—e.g. a jazz trumpet player—plays a fast ascending sequence of slurred notes, we will call this a "run up". A fast descending sequence of slurred notes is called a "run down". The timbre and articulation of notes in a run up or run down sequence have a particular character. This character is captured in the present invention by recording sound segments corresponding to the transitions between notes in a run up or run down sequence, and associating these sound segments with the run_up_slur or run_down_slur gesture subtype. These gesture subtypes are determined from the input control sequence using the conditions shown in FIG. 2. For the run_up_slur and run_down_slur gesture subtypes, the conditions reference the passed history of several note_on events in order to detect the run condition. Having determined the gesture subtype, find_segment ( ) finds the nearest pitch and intensity match among run_up_slur or run_down_slur transition sound segments.

The gesture table of FIG. 2 shows a falloff_release subtype belonging to the release gesture type. For certain instrumental styles—e.g. jazz trumpet and jazz saxophone—a characteristic gesture consists of executing a kind of soft downward lip or finger glissando on release of certain notes. We call this a "falloff release". In the present invention, the character of this gesture is captured by recording sound segments corresponding to falloff releases. These sound segments are generally taken from idiomatic performances of entire phrases. The falloff release sound segments are associated with the falloff_gesture subtype. This gesture subtype is determined from the input control sequence and the state transition diagram. A falloff release is selected on arrival in state 505 of FIG. 5. This occurs when overlapped note_on events are detected, such as would indicate a downward slurred phrasing, but when the second note of the slur is quickly released.

As can be seen, the state transition diagram of FIG. 5 and the gesture table of FIG. 2 include gesture types, gesture subtypes, and state transitions responsive to the input control sequence, which are specific to certain idiomatic instrumental playing styles. Other state transitions diagrams and gesture tables are used for different playing styles—e.g. classical violin. The essential character of the present invention is not changed by selecting different state transition diagrams or gesture tables.

Each sound segment is stored in the sound segment storage 301 at a particular pitch called the original pitch or, in the case of a transition segment, the beginning and ending original pitch. Normally, for each gesture subtype we want to store a number of sound segments at each pitch and intensity. However, this is generally impractical because of limited storage and the difficulty in collecting idiomatic recordings at every possible pitch and intensity for every gesture subtype. Consequently, it is often necessary to make use of a single sound segment at a variety of pitches and intensities by pitch-shifting and intensity-shifting the sound segment. In addition, it is often desirable to compress or expand the time duration of a sound segment to fit a particular musical context.

In one embodiment of the present invention, the sound segments are stored in 301 as time-domain waveform segments. Time-domain waveform segments can be pitch-shifted using sample rate conversion (SRC) techniques. With SRC, a waveform is resample at a new rate but played back at the original rate. This results in a change of pitch akin to speeding up or slowing down a tape recorder. In this case, not only is the pitch-shifted, but the duration of the segment is also compressed or expanded. This is not desirable for the present invention since we would like a particular gesture—e.g. an attack—to preserve its temporal characteristics after pitch-shifting. In addition, pitch-shifting using SRC techniques results in a compressed or expanded spectral envelope which often results in unnatural sounding spectral characteristics for the pitch-shifted sounds.

Intensity-shifting of sound segments can be done by simple amplitude scaling, but this can also produce an unnatural effect—e.g. a loud sound played softly often sounds like a loud sound far away, not a soft sound. In the case when compressing or expanding the time duration of a sound segment is desirable, we would like to separate this compression or expansion from the act of pitch-shifting a sound segment.

In a related invention by the present inventor entitled Audio Signal Synthesis System Based on Probabilistic Estimation of Time-Varying Spectra, U.S. Utility patent application Ser. No. 09/390,918, to Lindemann, a flexible system for pitch-shifting and intensity (or loudness) shifting of an audio signal is described. This systems shifts pitch and intensity while preserving a natural sounding time-varying spectrum and preserving the original temporal characteristics of the sound. This technique allows a sound segment associated with a particular gesture subtype to be used across a wide range of pitch and intensity. The sound segments are encoded using time-varying spectral coding vectors or using indices into spectral coding or waveform vector quantization (VQ) codebooks. Several types of spectral coding vectors or VQ codebooks can be used. These include sinusoidal amplitudes and frequencies, harmonic amplitudes, amplitude spectral coefficients, ceptra, etc. The particular form of spectral coding vector or VQ codebook does not affect the overall character of the system.

In another related invention by the present inventor entitled System for Encoding and Synthesizing Tonal Audio Signals, U.S. Utility patent application Ser. No. 09/306,256, to Lindemann, a particularly efficient system for encoding and storing sound segments is described. This system encodes tonal audio signals uses a small number of sinusoidal components in combination with a VQ codebook scheme. In addition, this system can be used to compress or expand the time duration of a sound segment without affecting the pitch of the segment.

The sound segment encoding methods of U.S. Utility patent application Ser. No. 09/306,256 in combination with the methods for pitch-shifting, and intensity-shifting sound segments described in U.S. Utility patent application Ser. No. 09/390,918 represent preferred methods for the present invention. However, other methods for storing, pitch-shifting, and intensity-shifting sound segments are known by those skilled in the art of audio signal coding, and the particular methods used do not affect the essential character of the present invention.

The encoding methods described above are used to encode all of the time-varying behavior of a complex sound segment such as the large interval downward slur (LDS) transition 162 of FIG. 1, between notes 126 and 128. As we have seen, this LDS transition consists of a number of distinct musical tones, noises, and silences of short duration, in addition to the principal tones. On staff 102*b* these tones include the three "lead-in" tones 146, the principal tone 147, the multitone 148, the silence 174 also indicated by rest 151, the noise component 175 also indicated by note 149, and the principal tone 150. The encoding methods described above record the complexity of this LDS transition but they do not provide a detailed list of the distinct musical tones, noises, and silences.

In another embodiment of the present invention, sound segments are encoded and stored using a "micro-sequence" structure. A micro-sequence consists of a detailed sequential list of musical tones, noises, and silences. Each tone in the sequence has a homogeneous pitch or spectral characteristic, or has an easily recognized monotonically changing pitch, intensity or spectral characteristic—e.g. the noise component 175 has a homogeneous spectral characteristic and a monotonically increasing intensity. The micro-sequence describes the detailed behavior of what may be perceived as a simple musical gesture e.g. the LDS transition mentioned above. Each musical tone, noise, or silence in the micro-sequence is separately encoded using one of the spectral coding or VQ coding techniques described above, or may simply be encoded as a time-domain waveform. The pitch and duration of each musical tone is explicitly listed in the micro-sequence.

The micro-sequence provides a particularly flexible representation for complex sound segments, and enables new forms of modifications and transformations of the sound segments. Some possible micro-sequence modifications include:

1. increasing or decreasing the duration of all non-principal tones in the micro-sequence.
2. increasing or decreasing the pitch of all non-principal tones in the micro-sequence relative to the pitches of the principal tones.
3. increasing or decreasing the duration of the principal tones without changing the duration of the non-principal tones.

Many other useful and interesting modifications can be made to a sound segment by exploiting the detailed information available in the micro-sequence.

The present invention includes an analysis system for segmenting musical phrases into sound segments. For each sound segment, the analysis system generates a sound segment descriptor that identifies the gesture type, the gesture subtype, the pitch and intensity—or pitches and intensities in the case of a transition segment, and location and phrase identifier from which the segment was taken. The analysis system then encodes the sound segment using one of the time-domain, spectral domain, or VQ coding techniques discussed above.

In the case of the embodiment of the present invention wherein sound segments are encoded as micro-sequences, the analysis system generates the detailed list of musical tones with associated pitches, intensities, durations, and with individual time-domain, spectral, or VQ encodings.

The analysis system may be fully automated, where all decisions about segmenting and gesture type identification are made using statistical inferences about the sounds based on a list of rules or heuristics defined a-priori. Alternatively, the analysis system may require much user intervention, where segments, gesture types, and gesture subtypes are identified manually using a graphic waveform editor. Pitches and intensities can also be found either automatically or manually. The degree of automation of the analysis system does not affect the essential character of the present invention.

I claim:

1. A musical synthesizer for synthesizing an ouptut audio signal in response to an input control sequence, comprising:

sound segment storage means for storing a collection of sound segments, wherein said collection includes a plurality of transitions between musical tones;

sound segment sequencer means responsive to said input control sequence for selecting a sequence of sound segments, including segments corresponding to transitions between musical tones, from said sound segment storage means; and sound segment player means for combining and playing out said sequence of sound segments to form said output audio signal.

2. The apparatus according to claim 1 wherein said input control sequence includes note-on events, and wherein each said note-on event includes a pitch value.

3. The apparatus according to claim 1 wherein said input control sequence includes note-on events, and wherein each said note-on event includes an intensity value.

4. The apparatus according to claim 1 wherein said input control sequence includes note-off events.

5. The apparatus according to claim 1 further including sound segment directory means for storing sound segment descriptors, wherein each said sound segment descriptor is associated with a selected sound segment in said sound segment storage means, and wherein each said sound segment descriptor includes pointers indicating the location of said selected sound segment in said sound segment storage means.

6. The apparatus according to claim 5 wherein said sound segment storage means stores complete musical phrases and wherein said pointers in said sound segment descriptors indicate locations of sound segments within said complete musical phrases.

7. The apparatus according to claim 5 wherein each said sound segment descriptor includes at least one pitch value describing the pitch of said selected sound segment.

8. The apparatus according to claim 1 wherein said input control sequence includes values describing physical movements of a performer as detected by a musical instrument controller.

9. The apparatus according to claim 1 wherein said plurality of transitions between musical tones includes sound segments corresponding to slurred transitions between musical tones.

10. The apparatus according to claim 9 wherein said sound segment sequencer means selects one of said slurred transitions in response to a pattern of overlapping note-on events from said input control sequence, wherein said overlapping note-on events comprise a first note-on event followed, eventually, by a second note-on event, prior to receiving a note-off event corresponding to said first note-on event.

11. The apparatus according to claim 1 wherein each said sound segment in said sound segment storage means is associated with a musical gesture type, and wherein said sound segment sequencer means further includes:

means for generating a sequence of musical gesture types in response to said input control sequence; and for each sequential musical gesture type in said sequence of musical gesture types, means for selecting a sound segment from said sound segment storage means, wherein the musical gesture type associated with said sound segment matches said sequential musical gesture type.

12. The apparatus according to claim 11 wherein each said sound segment in said sound segment storage means is further associated with a musical gesture subtype, and wherein said sound segment sequencer means further includes:

means for converting said sequence of musical gesture types into a sequence of musical gesture subtypes by evaluating, for each musical gesture type in said sequence of musical gesture types, a set of conditions based on said input control sequence; and for each sequential musical gesture subtype in said sequence of musical gesture subtypes, means for selecting a sound segment from said sound segment storage means, wherein the musical gesture subtype associated with said sound segment matches said sequential musical gesture subtype.

13. The apparatus according to claim 11 wherein said gesture types include an attack gesture type, a release gesture type, a transition gesture type, and a sustain gesture type.

14. The apparatus according to claim 12 wherein said gesture subtypes include a hard attack gesture subtype and a soft attack gesture subtype.

15. The apparatus according to claim 12 wherein said gesture subtypes include a large interval slur gesture subtype, and a small interval slur gesture subtype.

16. The apparatus according to claim 12 wherein said gesture subtypes include a slur gesture subtype.

17. The apparatus according to claim 1 wherein said transitions between musical tones include the ending part of a first musical tone and the beginning part of a following musical tone, and wherein any period of silence between the two musical tones is less than 250 milliseconds.

18. The apparatus according to claim 17 wherein said ending part of a first musical tone is associated with a first pitch value and said beginning part of a following musical tone is associated with a second pitch value.

19. The apparatus according to claim 17 wherein said ending part of a first musical tone is associated with a first intensity value and send beginning part of a following musical tone is associated with a second intensity value.

20. The apparatus according to claim 1 wherein said transitions between musical tones include slurred transitions between musical tones.

21. The apparatus according to claim 1 wherein said collection of sound segments further includes a plurality of sustain segments, wherein said sustain segments correspond to a part of a musical tone following an attack or transition segment and preceding a release or subsequent transition section.

22. The apparatus according to claim 21 wherein a selected number of said sustain segments correspond to single vibrato cycles.

23. The apparatus according to claim 1 wherein said sound segment player means further includes means for generating segment events to signal the end of sound segments and to signal a mid-point in said transition segments corresponding to when the pitch begins to change from a beginning pitch to an ending pitch during the transition, and wherein said sound segment sequencer means is further responsive to said to segment events.

24. The apparatus according to claim 1 wherein a first sound segment in said sequence of sound segments is partially played out, up to a stop play location, before switching to a second sound segment in said sequence of sound segments.

25. The apparatus according to claim 24 wherein said second sound segment in said sequence of sound segments is played out beginning at a start play location, and wherein said start play location is offset from the beginning of said second sound segment.

26. The apparatus according to claim 25 wherein said start play location is responsive to said stop play location.

27. The apparatus according to claim 25 wherein a first sound segment is played out partially up to a stop play location, and wherein the following sound segment is played out beginning at a start play location, and wherein said start play location is responsive to a cross-corellation function between the amplitude envelopes of said first sound segment and said following sound segment.

28. The apparatus according to claim 7 wherein said selecting a sequence of sound segments includes, for each selected sound segment, calculating the result of a distance measure between values from said input control sequence on the one hand and values from said sound segment descriptors in said sound segment directory on the other hand, and wherein finding the sound segment descriptor with the minimum distance value from among a selected number of said sound segment descriptors from said sound segment directory means, contributes to said process of selecting a sequence of sound segments.

29. The apparatus according to claim 28 wherein said distance function is responsive to the difference between the pitch value associated with a note-on event in said input control stream and a pitch value associated with a sound segment descriptor in said sound segment directory.

30. The apparatus according to claim 28 wherein a sound segment descriptor in said sound segment directory further includes an intensity value, and wherein said distance function is responsive to the difference between the intensity value associated with a note-on event in said input control stream and an intensity value associated with a sound segment descriptor in said sound segment directory.

31. The apparatus according to claim 28 wherein the difference between the beginning pitch and ending pitch in a transition sound segment corresponds to a sound segment interval value, and wherein the difference between the pitch values associated with two consecutive note-on events in said input control sequence corresponds to an input interval value, and wherein said distance function is responsive to the difference between an input interval value and a sound segment interval value.

32. The apparatus according to claim 1 wherein said sound segment player means further includes means for quickly terminating the playing out of a sound segment, and wherein said means for quickly terminating includes means for smoothly ramping down the amplitude of said sound segment, whereby an audible audio click is avoided.

33. The apparatus according to claim 1 wherein said sound segment player means further includes means for overlapping two sound segments, and wherein said means for overlapping includes means for ramping down the amplitude of a first sound segment while ramping up the amplitude of a following sound segment, whereby a smooth audio cross-fade is implemented between successive sound segments in said sequence of sound segments.

34. The apparatus according to claim 1 wherein said transition sound segments include run transitions, and wherein said run transitions correspond to the transition on between musical tones in a rapid ascending run up sequence of musical tones or a rapid descending run down sequence of musical tones.

35. The apparatus according to claim 1 wherein said sound segments include falloff release sound segments, wherein said falloff release sound segments correspond to downward glissando gestures at the release of a musical tone.

36. The apparatus according to claim 1 wherein said sound segment sequencer means further includes gesture table means for describing musical gesture types and musical gesture subtypes.

37. The apparatus according to claim 36 wherein said sound segment sequencer means further includes a plurality of gesture table means corresponding to different instrumental techniques and playing sytles.

38. The apparatus according to claim 1 wherein said sound segment sequencer means further includes state machine means for executing state transitions in response to said input control sequence, and wherein said state transitions are described by a state transition diagram.

39. The apparatus according to claim 38 wherein said sound segment sequencer means further includes a plurality of state transition diagrams corresponding to different instrumental techniques and playing sytles.

40. The apparatus according to claim 1 wherein said sound segment player means further includes means for pitch-shifting said sound segments.

41. The apparatus according to claim 40 wherein said means for pitch-shifting said sound segments further includes means for pitch-shifting the first part of a transition sound segment differently than the second part of a transition sound segment.

42. The apparatus according to claim 40 wherein said sound segment player means further includes means for intensity-shifting said sound segments.

43. The apparatus according to claim 1 wherein said sound segment player means further includes means for modifying the time duration of said sound segments.

44. The apparatus according to claim 1 wherein said sound segments in said sound segment storage means are encoded as time-domain waveforms.

45. The apparatus according to claim 1 wherein said sound segments in said sound segment storage means are encoded as a sequence spectral coding vectors.

46. The apparatus according to claim 45 wherein said spectral coding vectors include a number of sinusoidal amplitues in combination with indices into a vector quantization codebook.

47. The apparatus according to claim 46 wherein said vector quantization codebook includes time-domain waveforms.

48. The apparatus according to claim 40 wherein said pitch shifting means includes means for estimating the time-varying spectrum of a sound segment based on its time-varying pitch and time-varying intensity.

49. The apparatus according to claim 1 wherein said sound segments in said sound segment storage means are encoded as micro-sequences, and wherein each said micro-sequence includes a list of distinct musical sounds, and wherein each said distinct musical sound has a homogeneous spectral characteristic, or a monotonically changing characteristic.

50. The apparatus according to claim 49 wherein said sound segment player means includes means for individually modifying the duration of each said distinct musical sound in said micro-sequence.

51. The apparatus according to claim 49 wherein said sound segment player means includes means for individually modifying the pitch of each said distinct musical sound in said micro-sequence.

52. A method for synthesizing an ouptut audio signal in response to an input control sequence, comprising:

storing a collection of sound segments in a sound segment storage means, wherein said collection includes a plurality of transitions between musical tones;

generating a sequence of sound segments, selected from said collection of sound segments, in response to said input control sequence, wherein selected ones of said sound segments in said sequence of sound segments correspond to transitions between musical tones; and playing out and combining said sequence of sound segments to form said output audio signal.

53. The method according to claim 52 wherein each said sound segment in said sound segment storage means is associated with a musical gesture type, and wherein said step of generating a sequence of sound segments further includes the steps of:

generating a sequence of musical gesture types in response to said input control sequence; and for each sequential musical gesture type in said sequence of musical gesture types, the step of selecting a sound segment from said sound segment storage means, wherein the musical gesture type associated with said sound segment matches said sequential musical gesture type.

* * * * *